US008988290B2

(12) United States Patent
Ozden et al.

(10) Patent No.: US 8,988,290 B2
(45) Date of Patent: Mar. 24, 2015

(54) APPARATUS AND METHOD OF PROVIDING AN APPARATUS

(75) Inventors: Sinasi Ozden, Soborg (DK); Mirsad Cviko, Malmo (SE)

(73) Assignee: Nokia Corporation, Espoo (FI)

( * ) Notice: Subject to any disclaimer, the term of this patent is extended or adjusted under 35 U.S.C. 154(b) by 1455 days.

(21) Appl. No.: 12/617,775

(22) Filed: Nov. 13, 2009

(65) Prior Publication Data

US 2010/0123633 A1 May 20, 2010

(30) Foreign Application Priority Data

Nov. 15, 2008 (GB) ..... 0820939.7

(51) Int. Cl.
*H01Q 1/24* (2006.01)
*H01Q 5/00* (2006.01)
*H01Q 9/04* (2006.01)

(52) U.S. Cl.
CPC ..... *H01Q 1/243* (2013.01); *H01Q 5/0048* (2013.01); *H01Q 9/0421* (2013.01)
USPC ..... 343/702

(58) Field of Classification Search
USPC ..... 343/702, 872, 873, 906
See application file for complete search history.

(56) References Cited

U.S. PATENT DOCUMENTS

| | | | | |
|---|---|---|---|---|
| 5,434,579 | A * | 7/1995 | Kagoshima et al. | 343/700 MS |
| 6,590,539 | B2 | 7/2003 | Shinichi | 343/702 |
| 6,853,336 | B2 | 2/2005 | Asano et al. | 343/702 |
| 6,937,196 | B2 | 8/2005 | Korva | 343/702 |
| 6,963,308 | B2 | 11/2005 | Korva | 343/700 MS |
| 2004/0145527 | A1 | 7/2004 | Mikkola | 343/700 MS |
| 2004/0147297 | A1 | 7/2004 | Mikkola et al. | 455/575.7 |
| 2006/0097918 | A1 | 5/2006 | Oshiyama et al. | 343/700 |
| 2006/0135090 | A1 | 6/2006 | Annamaa | 455/95 |
| 2006/0208951 | A1 | 9/2006 | Korva et al. | 343/702 |
| 2006/0232475 | A1 | 10/2006 | Huang et al. | 343/700 MS |
| 2008/0018541 | A1 | 1/2008 | Pang et al. | 343/702 |
| 2008/0143630 | A1 | 6/2008 | Kato et al. | |
| 2009/0051604 | A1 * | 2/2009 | Zhang et al. | 343/702 |

FOREIGN PATENT DOCUMENTS

| | | |
|---|---|---|
| EP | 1 387 435 A1 | 2/2004 |
| EP | 1 439 602 A1 | 7/2004 |

(Continued)

OTHER PUBLICATIONS

Huang, C-F et al., "Realization of a Printed-On-Display Antenna for Mobile Terminals", © 2001, IEEE, pp. 140-143.

(Continued)

*Primary Examiner* — Robert Karacsony
(74) *Attorney, Agent, or Firm* — Harrington & Smith

(57) ABSTRACT

An apparatus and method of providing an apparatus, the apparatus including a conductive cover portion defining at least a portion of an external surface of the apparatus; a feed element configured to capacitively couple radio circuitry to the conductive cover portion at a feed point; a ground plane galvanically connected to the conductive cover portion at a ground point; wherein the feed point and the ground point are separated along a length of the conductive cover portion and configure the conductive cover portion to resonate at a first resonant frequency so as to be operable as an antenna in a first frequency band and wherein the first resonant frequency of the conductive cover portion is controlled by the separation between the feed point and the ground point.

17 Claims, 9 Drawing Sheets

(56) References Cited

FOREIGN PATENT DOCUMENTS

| | | | |
|---|---|---|---|
| EP | 1 439 603 | A1 | 7/2004 |
| EP | 1 667 282 | A1 | 6/2006 |
| JP | 11 136025 | | 5/1999 |
| WO | WO 2007/119304 | A1 | 10/2007 |
| WO | WO 2008/059106 | A1 | 5/2008 |

OTHER PUBLICATIONS

Shams, K.M. et al., "A Capacitively Coupled Polymeric Internal Antenna", © 2004 IEEE, pp. 1967-1970.

* cited by examiner

APPARATUS AND METHOD OF PROVIDING AN APPARATUS

FIELD OF THE INVENTION

Embodiments of the present invention relate to an apparatus and method of providing an apparatus. In particular, they relate to an apparatus and method of providing an apparatus wherein the apparatus comprises a conductive cover portion.

BACKGROUND TO THE INVENTION

Apparatus for wireless communication are known. In order to communicate in a particular frequency band the apparatus must comprise an antenna arrangement which is operable within that frequency band. Efficient operation occurs when the insertion loss of the antenna arrangement is better than an operational threshold such as −6 dB.

There is a trend to decrease the volume of such apparatus. Consequently there is also a trend to decrease the volume of the apparatus which is taken up by antenna arrangements. However it is important to ensure that the antenna arrangement will still operate efficiently in the desired frequency bands.

BRIEF DESCRIPTION OF VARIOUS EMBODIMENTS OF THE INVENTION

According to various, but not necessarily all, embodiments of the invention there is provided an apparatus comprising; a conductive cover portion defining at least a portion of an external surface of the apparatus; a feed element configured to capacitively couple radio circuitry to the conductive cover portion at a feed point; a ground plane galvanically connected to the conductive cover portion at a ground point; wherein the feed point and the ground point are separated along a length of the conductive cover portion and configure the conductive cover portion to resonate at a first resonant frequency so as to be operable as an antenna in a first frequency band and wherein the first resonant frequency of the conductive cover portion is controlled by the separation between the feed point and the ground point.

The conductive cover portion may define an aperture.

In some embodiments of the invention the conductive cover portion may be a bezel around an edge of an external surface of the apparatus. In other embodiments the conductive cover portion may be a bezel around an edge of a display or a user input device.

In some embodiments of the invention the conductive cover portion may be configured to operate as a PIFA (planar inverted F antenna) in the first frequency band.

In some embodiments of the invention the apparatus may also comprise a matching circuit configured to enable the conductive cover portion to resonate at the first resonant frequency and at a second resonant frequency so that the conductive cover portion is operable as an antenna in both the first frequency band and a second frequency band.

In some embodiments of the invention the apparatus may also comprise an antenna element within the apparatus. The antenna element may be configured to resonate at a third resonant frequency so as to be operable as an antenna in a third frequency band. The third frequency band may be a cellular frequency band.

According to various, but not necessarily all, embodiments of the invention there is provided an apparatus comprising; a conductive cover portion defining at least a portion of an external surface of the apparatus; at least one feed element configured to capacitively couple radio circuitry to the conductive cover portion at least at one feed point; a ground plane galvanically connected to the conductive cover portion at a ground point; wherein the feed point and the ground point are separated along a length of the conductive cover portion and configure the conductive cover portion to resonate at a first resonant frequency and a second resonant frequency so as to be operable as an antenna in at least a first frequency band and a second frequency band and wherein the first resonant frequency and the second resonant frequency of the conductive cover portion are controlled by the separation between the feed point and the ground point.

In some embodiments of the invention the ground plane may be galvanically connected to the conductive cover portion via decoupling circuitry.

In some embodiments of the invention the conductive cover portion does not overlay the ground plane. In some embodiments of the invention the conductive cover portion may define a portion of the rear external surface of the apparatus.

In some embodiments of the invention a first feed element may be configured to resonate in conjunction with the conductive cover portion at the first resonant frequency and a second feed element may be configured to resonate in conjunction with the conductive cover portion at the second resonant frequency.

In some embodiments of the invention the first feed element and the second feed element may be connected to the radio circuitry by the same connection.

In some embodiments of the invention there is provided a portable electronic device comprising the apparatus.

According to various, but not necessarily all, embodiments of the invention there is provided a method comprising: providing a conductive cover portion defining at least a portion of an external surface of an apparatus; configuring a feed element to capacitively couple radio circuitry to the conductive cover portion at a feed point; configuring a ground plane to be galvanically connected to the conductive cover portion at a ground point; positioning the feed point and the ground point such that the feed point and the ground point are separated along a length of the conductive cover portion and the conductive cover portion is configured to resonate at a first resonant frequency so as to be operable as an antenna in a first frequency band and wherein the first resonant frequency of the conductive cover portion is controlled by the separation between the feed point and the ground point.

According to various, but not necessarily all, embodiments of the invention there is provided a method comprising: providing a conductive cover portion defining at least a portion of an external surface of an apparatus; configuring at least one feed element to capacitively couple radio circuitry to the conductive cover portion at a feed point; configuring a ground plane to be galvanically connected to the conductive cover portion at a ground point; positioning the feed point and the ground point such that the feed point and the ground point are separated along a length of the conductive cover portion and the conductive cover portion is configured to resonate at a first resonant frequency and a second resonant frequency so as to be operable as an antenna in a first resonant frequency band and a second resonant frequency band and wherein the first resonant frequency and the second resonant frequency of the conductive cover portion is controlled by the separation between the feed point and the ground point.

The apparatus may be for wireless communication.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
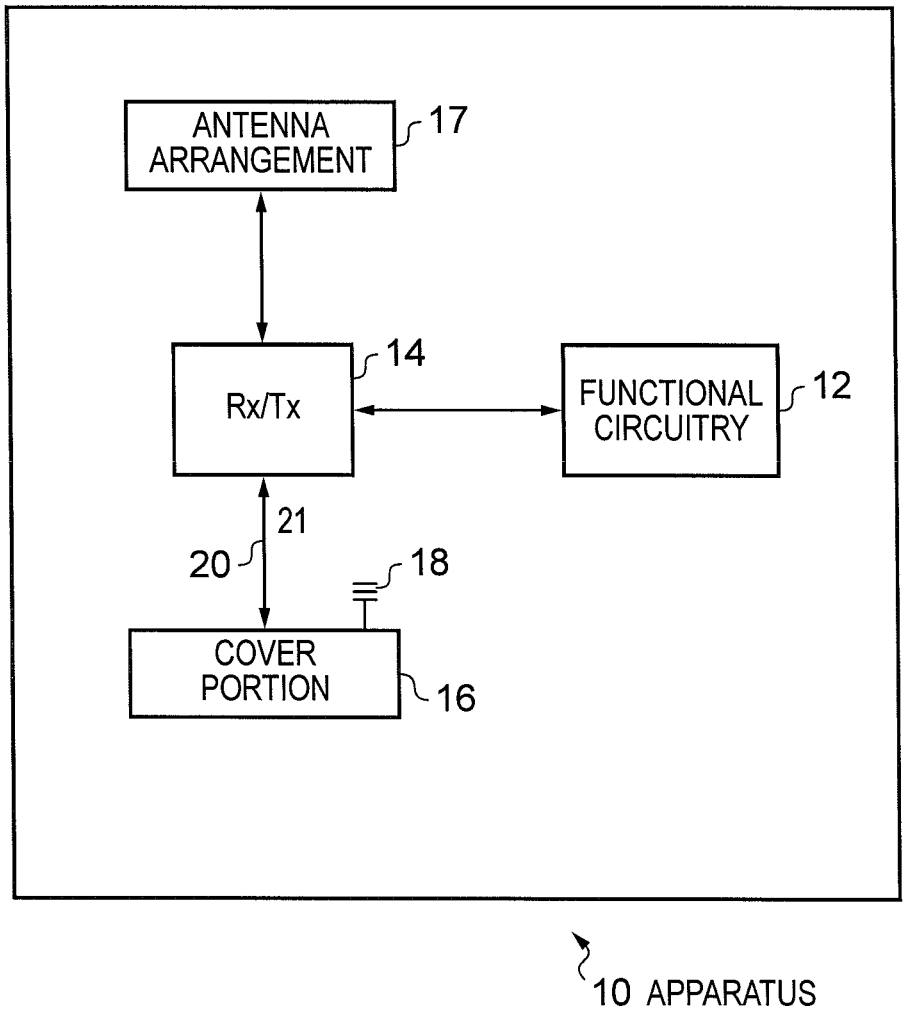
FIG. 1 schematically illustrates an apparatus according to embodiments of the invention.

The Figures illustrate an apparatus 10 comprising; a conductive cover portion 16 defining at least a portion of an external surface 34 of the apparatus 10; a feed element 20 configured to capacitively couple radio circuitry 14 to the conductive cover portion 16 at a feed point 40; a ground plane 44 galvanically connected to the conductive cover portion 16 at a ground point 42; wherein the feed point 40 and the ground point 42 are separated along a length of the conductive cover portion 16 and configure the conductive cover portion 16 to resonate at a first resonant frequency so as to be operable as an antenna in a first frequency band and wherein the first resonant frequency of the conductive cover portion 16 is controlled by the separation between the feed point 40 and the ground point 42.

In the following description, unless expressly stated otherwise, the words 'connect' and 'couple' and their derivatives mean operationally connected/coupled. It should be appreciated that any number or combination of intervening components can exist (including no intervening components). Additionally, it should be appreciated that, unless expressly stated otherwise, the connection/coupling may be physical galvanic connection and/or an electromagnetic connection.

FIG. 1 schematically illustrates an apparatus 10 according to embodiments of the invention. Only features referred to in the following description are illustrated. It should, however, be understood that the apparatus 10 may comprise additional features that are not illustrated. The apparatus 10 comprises functional circuitry 12, radio circuitry 14 and a conductive cover portion 16. The apparatus 10 may also comprise an antenna arrangement 17.

The apparatus 10 may be for wireless communication. The apparatus 10 may be a portable electronic device, for example, the apparatus 10 may be a hand portable electronic device which can be carried in a user's hand, handbag or jacket pocket. The apparatus 10 may be a mobile cellular telephone, a personal digital assistant (PDA), a laptop computer, a palm top computer, a portable WLAN or WiFi device, or a module for such devices. As used here, 'module' refers to a unit or apparatus that excludes certain parts/components that would be added by an end manufacturer or user.

The conductive cover portion 16 defines a portion of the external surface 34 of the apparatus 10. The external surface 34 is on the outside of the apparatus 10 and is visible when the apparatus 10 is in use. The external surface 34 may be touched by a user of the apparatus 10 when the apparatus 10 is in use such that the conductive cover portion 16 may come into direct contact with a part of the user, for example the user's hand or ear.

The conductive cover portion 16 may be part of a casing 38 which houses the electronic components of the apparatus 10. The casing 38 and the conductive cover portion 16 may protect the electronic components from damage. For example the casing 38 may protect the electronic components from damage due to impacts or from atmospheric conditions such as water. The casing 38 may comprise non-metallic portions. A non-metallic portion of the casing 38 may be located on one or more sides of the apparatus 10.

The conductive cover portion 16 may provide other functions in addition to being configured to resonate at a first resonant frequency. For example, the conductive cover portion 16 may provide an aesthetic aspect to the apparatus 10. The conductive cover portion 16 may be a bezel or a trim around an edge 36 of an external surface 34 of the apparatus 10 or around an edge 61 of a display 32 or user input device 30 such as a keypad and may be designed to improve the aesthetic appearance of the apparatus 10. In such embodiments the conductive cover portion 16 may protect the apparatus 10 or the casing 38 from damage, for example in embodiments where the conductive cover portion 16 is a bezel or a trim around an edge 36 of an external surface 34 of the apparatus 10 or around an edge 61 of a display 32, or a user input device 30 such as a keypad, the conductive cover portion 16 may also be configured to protect the edges 36, 61 from damage. In some embodiments the conductive cover portion 16 may also assist in holding parts of the casing 38 or display 32 or a user input device such as a keypad 30 securely in position with respect to other parts of the casing 38.

The conductive cover portion 16 may be made of any suitable material which is conductive and also hard wearing such as stainless steel or aluminium.

The conductive cover portion 16 is capacitively coupled to the radio circuitry 14 by a feed line 21 and a feed element 20 at a feed point 40. The feed line 21 extends from the radio circuitry 14 to the feed element 20. The feed line 21 may act as an inductor in series with the capacitance of the feed element 20.

The conductive cover portion 16 is also galvanically connected to a ground plane 44 by a ground connection 18 at a ground point 42. The feed point 40 and the ground point 42 are separated along a length of the conductive cover portion 16 and configure the conductive portion to resonate at a first resonant frequency in a first frequency band. The feed element 20 and the feed point 40 may be located so that they are positioned underneath the non-metallic portions of the casing 38.

The functional circuitry 12 comprises circuitry which controls the apparatus 10. The functional circuitry 12 may comprise a controller which may comprise a processor and a memory. In embodiments where the apparatus 10 is a mobile cellular telephone, the functional circuitry 12 may also comprise input/output devices such as a microphone, a loudspeaker, a display 32 and a user input device such as a keypad 30.

The radio circuitry 14 is connected to the functional circuitry 12 and, as mentioned above, is capacitively coupled to the conductive cover portion 16. The functional circuitry 12 is configured to provide data to the radio circuitry 14. The radio circuitry 14 is configured to encode the data and provide it to the conductive cover portion 16 for transmission. The conductive cover portion 16 is configured to transmit the encoded data as a radio signal in a first frequency band.

The conductive cover portion 16 is also configured to receive a radio signal in the first radio frequency band. The antenna arrangement 12 then provides the received radio signal to the radio circuitry 14 which decodes the radio signal into data and provides the data to the functional circuitry 12.

In some embodiments of the invention the radio circuitry 14 may also be configured to provide data to an antenna arrangement 17 for transmission and to decode radio signals received by the antenna arrangement 17 into data and provide the data to the functional circuitry 12. The antenna arrangement 17 is located within the apparatus 10. The antenna arrangement 17 may be located so that it is positioned underneath the non-metallic portion of the casing 38. The antenna arrangement 17 is configured to transmit data as a radio signal and also receive a radio signal which is then provided to the radio circuitry 14.

The antenna arrangement 17 may be configured to operate in a plurality of different operational radio frequency bands and via a plurality of different protocols. For example, the different frequency bands and protocols may include (but are not limited to) AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz); LTE 700 (US) (698-716 MHz [Tx] and 728-746 MHz [Rx]); LTE 1500 (Japan) (1427.9-1452.9 MHz [Tx] and 1475.9-1500.9 MHz [Rx]); LTE 2600 (Europe) (2500-2570 MHz [Tx] and 2620-2690 MHz [Rx]). The electrical length of the antenna arrangement 17 may be tuned in order to achieve these frequencies and protocols.

The antenna arrangement 17 may be configured to operate in a different frequency band to the conductive cover portion 16.

The electronic components that provide the functional circuitry 12 the radio circuitry 14 and the antenna arrangement 17 may be interconnected via a printed wiring board (PWB). The PWB may also function as the ground plane 44 for the antenna arrangement 17 and the conductive cover portion 16.

In other embodiments of the invention the ground plane 44 may be provided by any conductive feature within the apparatus 10. The ground plane 44 may not be planar, for example it may comprise a plurality of different components in different planes which need not necessarily include a PWB or it could include components which are not flat or planar shaped.

Figure 2:
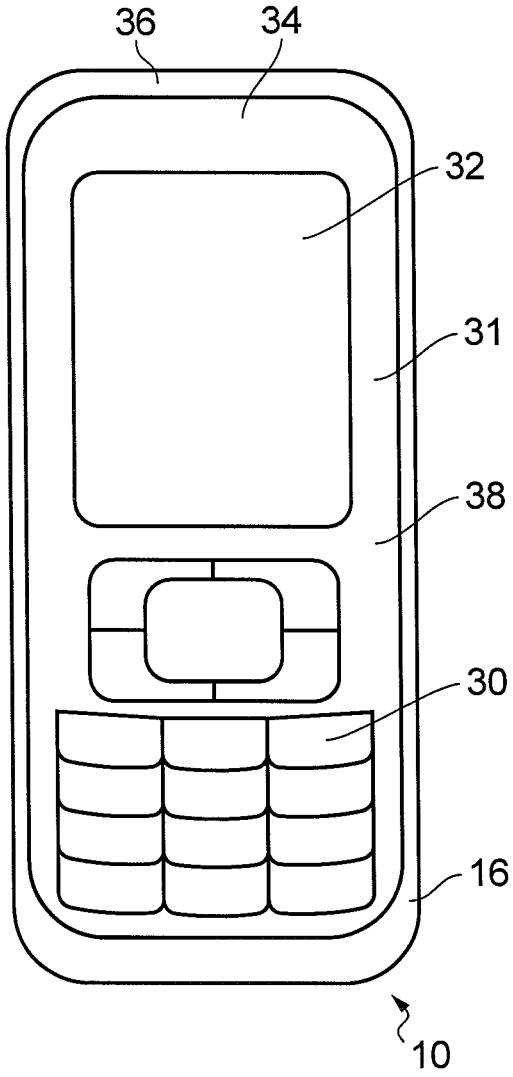
FIG. 2 illustrates an apparatus according to a first embodiment of the invention.

FIG. 2 illustrates an apparatus 10 according to a first example embodiment of the invention. The apparatus 10 comprises a casing 38 which defines an external surface 34 of the apparatus 10. The electronic components of the apparatus 10 including the radio circuitry 14, the functional circuitry 12 and the antenna arrangement 17 are housed within the casing 38 and are not shown in FIG. 2.

The casing 38 comprises a conductive cover portion 16. In the illustrated embodiment the conductive cover portion 16 is a bezel which is a metal trim which extends around the edge 36 of the front external surface 34 of the apparatus 10. In the particular embodiment illustrated in FIG. 2 the conductive cover portion 16 extends around the entire perimeter of the front external surface 34 to form an aperture 31. The part of the casing 38 which defines the front external surface 34 is securely fixed in place within the aperture 31.

The conductive cover portion 16 is substantially rectangular with rounded corners. The aperture 31 defined by the conductive cover portion 16 is also substantially rectangular. In the illustrated embodiment the conductive cover portion 16 is substantially flat so that the conductive cover portion 16 is in a single plane. In other embodiments of the invention the conductive cover portion 16 may be a different shape. For example in the illustrated embodiment the conductive cover portion 16 is located on the front surface of the apparatus 10. In other embodiments of the invention the conductive cover portion 16 may be shaped so that it is not substantially flat and is in more than one plane. For example, part of the conductive cover portion 16 may be located on the front surface of the apparatus 10 but it may also curve around the apparatus 10 so that it also extends onto the edges and possibly even rear surface of the apparatus 10.

In the illustrated embodiment the conductive cover portion 16 extends around the entire perimeter of the front external surface 34 of the apparatus 10. In other embodiments of the invention the conductive cover portion 16 may extend only part way around the perimeter of the front external surface 34 so that there is a gap in the conductive cover portion 16.

In the illustrated embodiment the apparatus 10 is a mobile cellular telephone and comprises a display 32 and a user input device 30. The display 32 and the user input device 30 are positioned on the front external surface 34. In the illustrated embodiment the user input device 30 is a keypad. In other embodiments of the invention other types of user input device may be used such as touch sensitive portions of a display or a joystick or a roller key. The other types of user input device may be used in place of or in addition to the key pad.

Figure 3A:
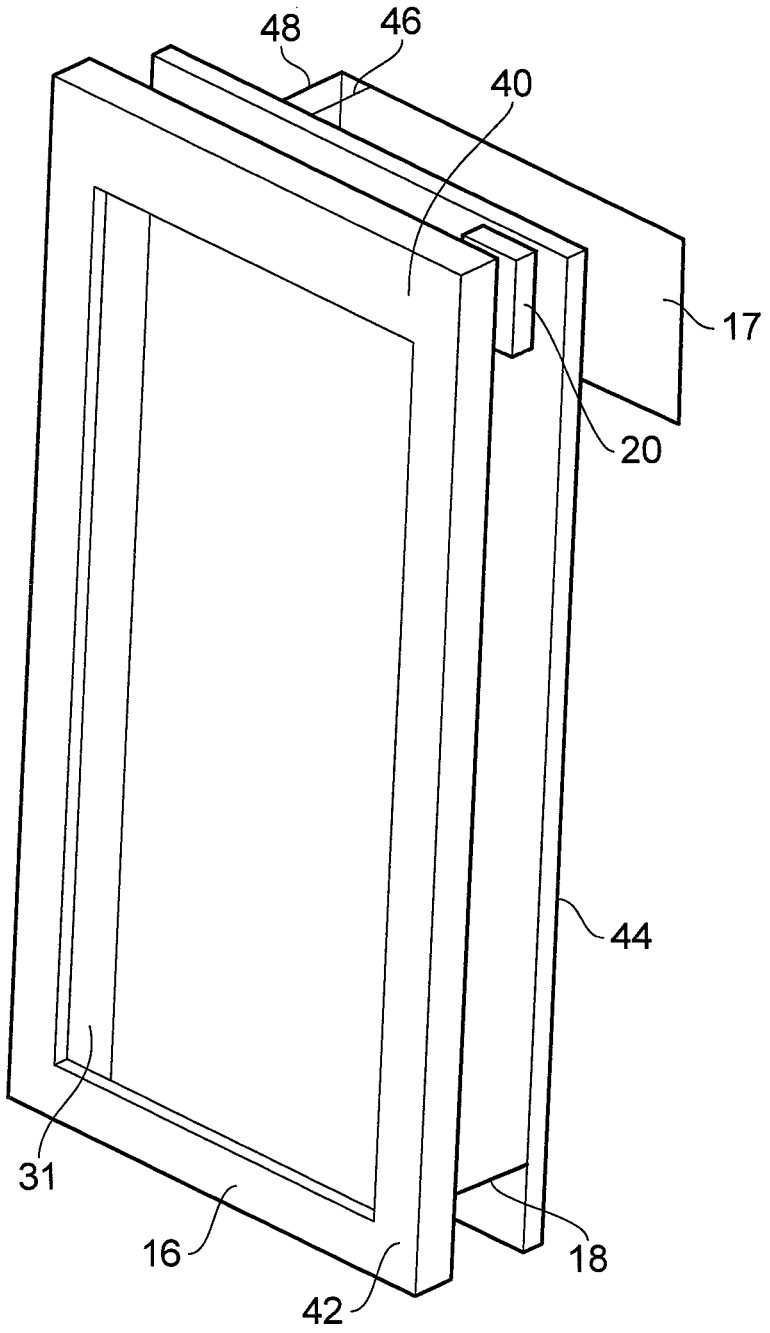
FIG. 3A is a perspective view of the first embodiment of the invention.
Figure 3B:
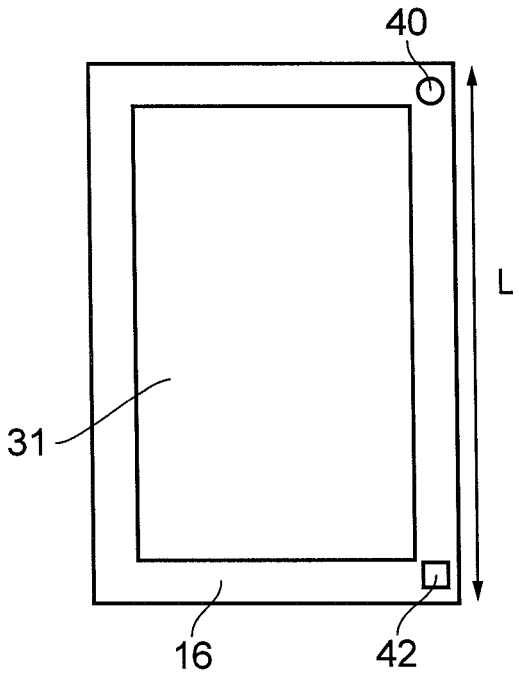
FIG. 3B is a plan view of the first embodiment of the invention.
Figure 3C:
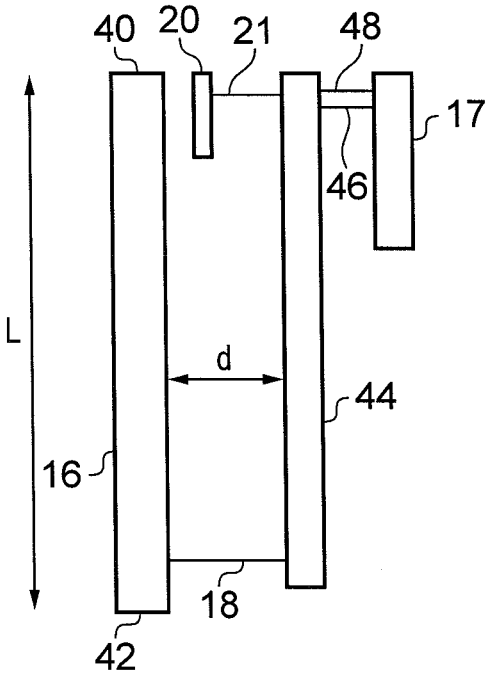
FIG. 3C is a side view of the first embodiment of the invention.

FIGS. 3A to 3C illustrate the first example embodiment of the invention illustrated in FIG. 2 in more detail. In these Figs the casing 38 and the functional circuitry 12 and radio circuitry 14 are not shown for clarity. FIG. 3A is a perspective view of the first embodiment of the invention, FIG. 3B is a plan view of the first embodiment of the invention and FIG. 3C is a side view of the first embodiment of the invention.

FIGS. 3A to 3C illustrate the conductive cover portion 16, the ground plane 44 and the antenna arrangement 17. The ground plane 44 and the antenna arrangement 17 would be positioned inside the casing 38.

The ground plane 44 is substantially flat and is located in a first plane a distance d from the conductive cover portion 16. In some embodiments of the invention the ground plane 44 may also be a PWB. As mentioned above, the radio circuitry 14 and the functional circuitry 12 have not been illustrated in FIGS. 3A to 3C for clarity but these may be mounted on the PWB and may be interconnected to the conductive cover portion 16 and the antenna arrangement 17 via the PWB.

The conductive cover portion 16 is a bezel which forms an aperture 31 as illustrated in FIG. 2 and described above.

As can be seen in FIGS. 3A to 3C the conductive cover portion 16 has a length which is slightly longer than the length of the ground plane 44 and a width which is slightly wider than the width of the ground plane 44. The conductive cover portion 16 is in a plane parallel to the ground plane 44 and is positioned a distance d from the ground plane 44.

In the embodiment illustrated in FIG. 3 a feed element 20 is positioned between the ground plane 44 and the conductive cover portion 16. In other embodiments of the invention the feed element 20 may be mounted on the ground plane 44.

The feed element 20 capacitively couples the radio circuitry 14 to the conductive portion 16 at the feed point 40. The feed point 40 is positioned in a corner of the conductive cover portion 16. The feed point 40 and the feed element 20 may be positioned within the apparatus 10 so that they are positioned underneath the non-metallic portion of the casing 38.

A feed line 21 extends from the radio circuitry 14 to the feed element 20. The feed line 21 may act as an inductor in series with the capacitance of the feed element 20. The feed line 21 may extend along the ground plane 44.

A ground connection 18 is also positioned between the ground plane 44 and the conductive cover portion 16. The ground connection 18 galvanically connects the conductive cover portion 16 to the ground plane 44 at the ground point 42.

The feed point 40 and the ground point 42 are separated along a length of the conductive cover portion by a distance L. In the illustrated embodiment both the feed point 40 and the ground point 42 are provided along the same side of the rectangular conductive cover portion 16. In other embodiments the feed point 40 and the ground point 42 may be provided on different sides of the conductive cover portion 16. The relative positions of the feed point 40 and the ground point 42 may be selected to configure the conductive cover portion 16 to resonate at a first resonant frequency in a first resonant frequency band.

The antenna arrangement 17 is substantially flat and is also positioned in a plane parallel to the ground plane 44. The antenna arrangement 17 may be, for example, a PIFA. In the illustrated embodiment the antenna arrangement 17 is positioned on the opposite side of the ground plane 44 to the conductive cover portion 16. Positioning the antenna element 17 on the opposite side of the ground plane 44 to the conductive cover portion 16 may reduce the electromagnetic coupling between the antenna element 17 and the conductive cover portion 16.

The antenna arrangement 17 is coupled to the radio circuitry 14 by a feed 48 and coupled to the ground plane 44 by a ground connection 46. The feed 48 of the antenna arrangement 17 may be positioned close to the feed element 20 of the conductive cover portion 16 so that the feed 48 of the antenna arrangement 17 and the feed element of the conductive cover portion 16 may be positioned in line with the non-metallic portion of the casing 38. This enables the feed elements to act as radiators.

In the above described embodiment feed element 20 and the ground connection 18 configure the conductive cover portion 16 to operate as a slotted PIFA. The feed point 40 and the ground point 42 are separated along the length of the conductive cover portion 16. The length L of the separation between the feed point 40 and the ground point 42 can be controlled to control the impedance of the conductive cover portion 16 and consequently control the resonant frequency so that the conductive cover portion 16 is operable as an antenna in a first frequency band.

The length of the feed line 21 may also be selected in order to configure the conductive cover portion 16 to resonate and be operable as an antenna in a first frequency band. The distance between the ground plane 44 and the conductive cover portion 16 may also be selected so that the conductive cover portion 16 is configured to resonate and be operable as an antenna in a first frequency band.

The first frequency band may be, for example, 2400-2483.5 MHz and the conductive cover portion 16 may be used as an antenna arrangement for communications in a wireless local area network (WLAN) or Bluetooth network. In such embodiments of the invention the length of the feed line 21 may be 20 mm and the distance between the ground plane 44 and the feed element 20 may be 1 mm. The feed element 20 may have an area of 4 $mm^2$. The distance between the ground plane 44 and the conductive cover portion 16 may be 2.5 mm. Any ground layers associated with the ground plane 44 which may be in the form of a multi-layer printed wiring board may be removed in the region of the feed line 21 and feed element 20, this may further allow the feed line 21 and feed element 20 to radiate through the non-metallic portion of the casing 38. The feed line 21 and the feed element 20 may also be provided on the printed wiring board. In embodiments of the invention where the printed wiring board is a multi-layer printed wiring board the feed line 21 and feed element may be provided on one or more of the layers.

In other embodiments of the invention the conductive cover portion 16 may be configured to be operable as an antenna in a different frequency band via a different protocol such as HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); DRM (0.15-30 MHz); Wi Max (2300-2400 MHz, 2305-2360 MHz, 2496-2690 MHz, 3300-3400 MHz, 3400-3800 MHz, 5250-5875 MHz).

In some embodiments of the invention the conductive cover portion 16 may be configured to have an electrical length which is longer at the operating frequency. This causes the conductive cover portion 16 (by itself) to resonate at a frequency below the operating frequency. The feed element 20 may be configured to have a shorter electrical length at the operating frequency causing the feed element 20 (by itself) to resonate at a frequency above the operating frequency. The loading caused by the conductive cover portion 16 on the feed element 20 tunes the resonant frequency of the feed element 20 to the desired operating frequency.

As the conductive cover portion 16 defines part of the external surface 34 of the apparatus 10 it may make direct contact with a user. For example, in the illustrated embodiment the apparatus 10 is a mobile phone which may be held in a user's hand or positioned next to their ear. This may cause a build up of electrostatic charge on the conductive cover portion 16. This build up of charge may then result in electrostatic discharge which could damage sensitive electronic components which may be found in the radio circuitry 14. In embodiments of the invention the radio circuitry 14 is capacitively coupled to the conductive portion 16. As the conductive cover portion 16 is physically separated from the radio circuitry 14 by the dielectric of the capacitor this reduces the detuning effect which occurs when the conductive cover portion 16 comes into contact with the users hand or ear. This may also prevent electrostatic discharge from being transmitted to the radio circuitry 14 and damaging the radio circuitry 14.

Also the conductive cover portion 16 is galvanically connected to the ground plane 44. This also protects the radio circuitry because any electrostatic charge which builds up on the conductive cover portion 16 can then dissipate through the ground connection 18 rather than through the feed element 20.

The antenna arrangement 17 may be operable in a different frequency band to the conductive cover portion 16. For example the antenna arrangement 17 may be operable in a cellular communications band such as EGSM 900 (880-960 MHz), PCN/DCS 1800 (1710-1880 MHz), WCDMA 2100 (Tx: 1920-1980 MHz Rx: 2110-2180 MHz). The antenna arrangement 17 may be operable in a plurality of communication bands. There may also be other antenna arrangements within the portable electronic device for use in other frequency bands.

As the conductive cover portion 16 defines part of an external surface 34 of the apparatus 10 it does not take up any volume inside the apparatus 10. This enables the volume of the apparatus 10 to be reduced. Alternatively it enables an additional antenna arrangement to be added to an existing apparatus 10 without increasing the volume of the apparatus 10, or enabling the volume which would have been taken by the antenna arrangement to be used for alternative features.

Figure 4:
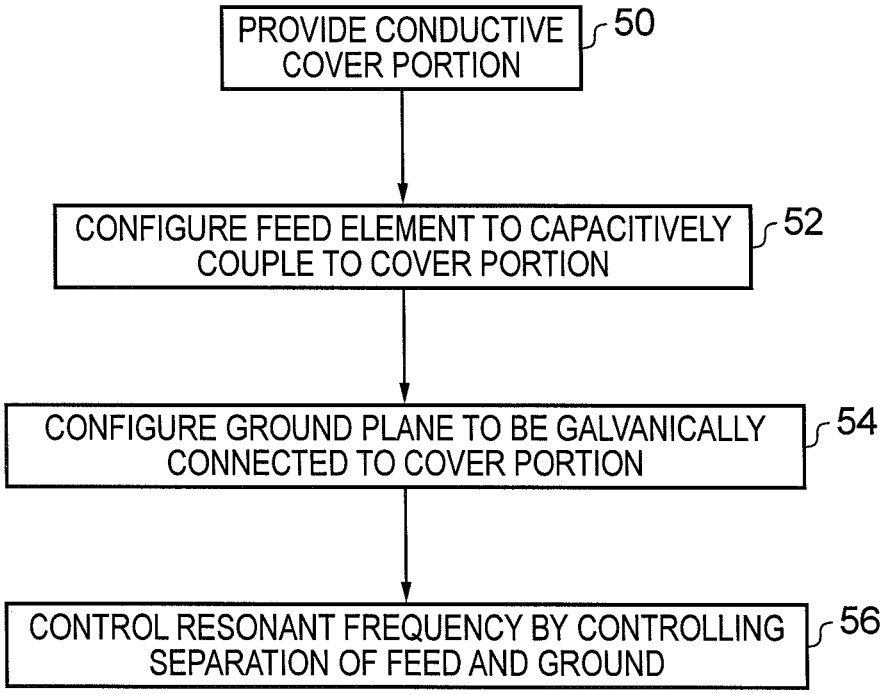
FIG. 4 illustrates a flow chart showing method blocks of an embodiment of the present invention.

FIG. 4 illustrates a method of providing an apparatus according to an embodiment of the invention. At block 50 a conductive cover portion 16 is provided. As mentioned above the conductive cover portion 16 may be part of the casing 38 of the apparatus 10.

At block 52 the feed element 20 is configured to capacitively couple the conductive cover portion 16 to the radio circuitry 14 and at block 54 the ground plane 44 is galvanically connected to the conductive cover portion 16 so that the conductive cover portion 16 is configured to operate as an antenna.

At block 56 the resonant frequency of the conductive cover portion 16 is controlled by controlling the separation between the feed point 40 and the ground point 42 so that the conductive cover portion is operable at a selected frequency within a resonant frequency band.

Although the blocks of the method are illustrated in a particular order in FIG. 4 the illustration of a particular order of the blocks does not necessarily imply that there is a required or preferred order for the blocks and the order and arrangement of the block may be varied. Furthermore, it may be possible for some steps to be omitted.

Figure 5:
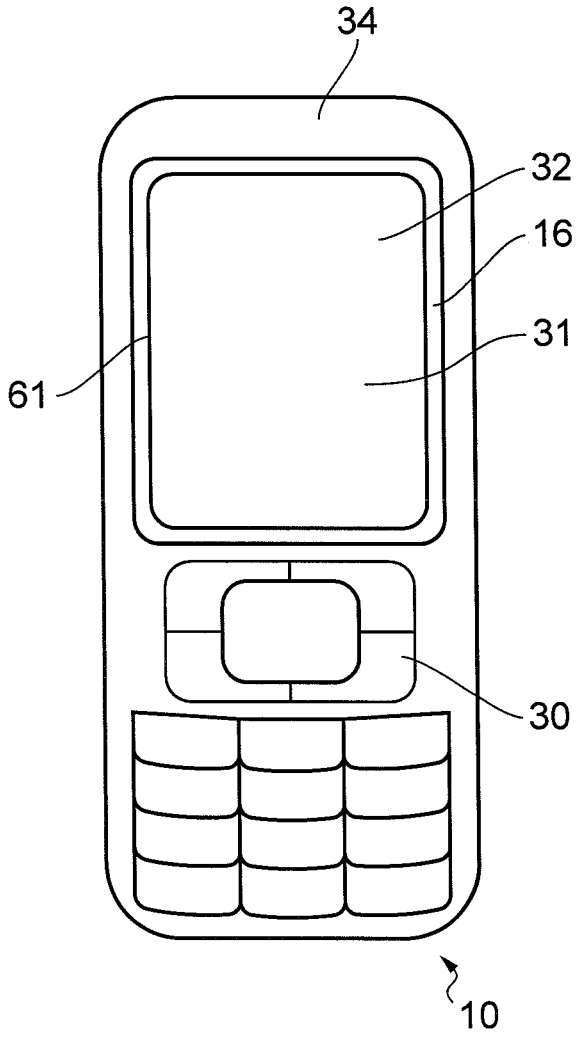
FIG. 5 illustrates an apparatus according to a second embodiment of the invention.

FIG. 5 illustrates the casing 38 of an apparatus 10 according to a second example embodiment of the invention. Similar to the embodiment illustrated in FIG. 2 the apparatus 10 is a mobile cellular telephone and comprises a display 32 and a keypad 30 positioned on the front external surface 34. The electronic components of the apparatus 10 including the radio circuitry 14, the functional circuitry 12 and the antenna arrangement 17 are housed within the casing 38 and not visible in the illustrated view.

In FIG. 5 the conductive cover portion 16 is a bezel which is a metal trim which extends around the edge 61 of the display 32. The conductive cover portion 16 may be configured to protect the edges of the display 32 from damage and also to hold the display 32 securely in position in with respect to other elements of the casing 38.

The conductive cover portion 16 which surrounds the display 32 is capacitively coupled to a radio circuitry 14 via a feed element 20 and is galvanically connected to a ground plane 44 and operates in the same manner as the embodiment illustrated in FIG. 2 and FIGS. 3A to 3C and described above.

Figure 6A:
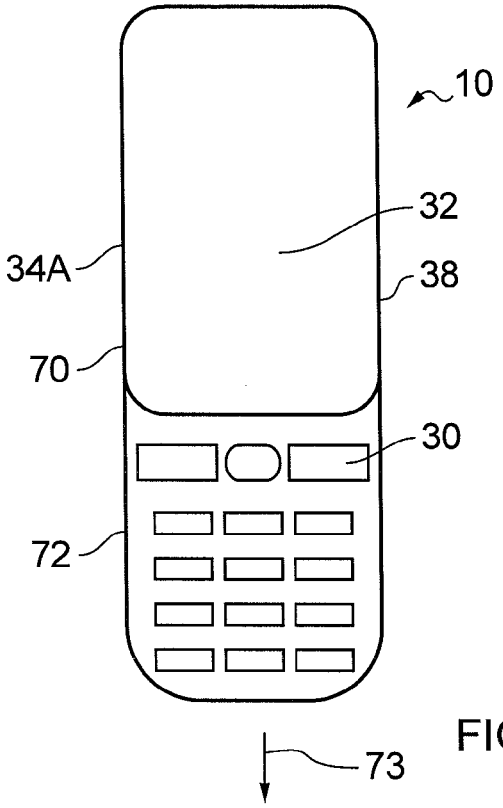
FIG. 6A is a front view of an apparatus according to a third embodiment of the invention.
Figure 6B:
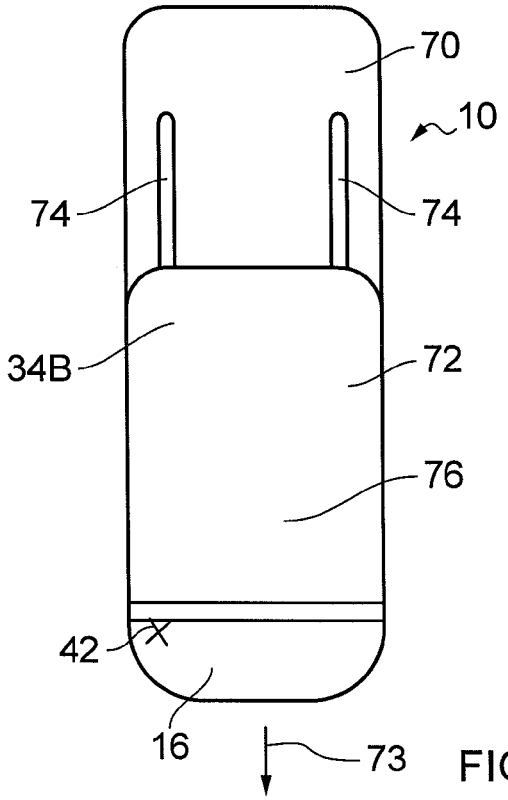
FIG. 6B is a rear view of an apparatus according to the third embodiment of the invention.

FIGS. 6A and 6B illustrate an apparatus 10 according to a third example embodiment of the invention. The apparatus 10 according to the third embodiment also comprises a casing 38 which defines an external surface 34 of the apparatus 10. The casing 38 defines a front external surface 34A which is illustrated in FIG. 6A and a rear external surface 34B which is illustrated in FIG. 6B.

As with the previous embodiments the electronic components of the apparatus 10 including the radio circuitry 14, the functional circuitry 12 and the antenna arrangement 17 are housed within the casing 38 and are not shown in FIGS. 6A and 6B.

In the third embodiment of the invention the apparatus 10 is a mobile cellular telephone and comprises a display 32 and a user input device 30. In the illustrated embodiment the user input device 30 is a keypad.

The apparatus 10 has a first portion 70 and a second portion 72. The first portion 70 is mounted on the second portion 72 so that the first portion 70 can move relative to the second portion 72 between a first position and a second position. In the illustrated embodiment the first portion 70 is mounted on slide tracks 74 so that the first portion 70 can slide relative to the second portion 72.

It is to be appreciated that in other embodiments of the invention the apparatus 10 may have a different configuration. For example, the first portion 70 may be mounted on the second portion 72 by a hinge so that the first portion can rotate relative to the second portion 72 and the first portion 70 can be folded onto the second portion 72. Other configurations may also be possible, for example, the first portion 70 may be twisted relative to the second portion 72. In other embodiments of the invention the apparatus 10 may comprise only a single portion.

The display 32 is positioned on the first portion 70 and the user input device 30 is positioned on the second portion 72. In FIGS. 6A and 6B the first portion 70 is illustrated in a first position in which the user input device 30 is accessible and the display 32 can be viewed. The first portion 70 may be moved to the second position by moving downwards, relative to the second portion 72, in the direction of arrow 73 until the first portion 70 overlays the second portion 72. When the first portion 70 is in the second position the user input device 30 is covered by the first portion 70 and cannot be actuated.

In the particular embodiment illustrated in FIGS. 6A and 6B the front external surface 34A may comprise one or more conductive portions. The conductive portions may comprise metal or plated plastics. The front external surface 34A may also comprise one or more non-conductive portions as well as conductive portions. In other embodiments of the invention the front external surface may only comprise non-conductive cover portions.

The rear external surface 34B is illustrated in FIG. 6B. FIG. 6B also illustrates the first portion 70 in the first position relative to the second portion 72 as in FIG. 6A. The slide tracks 74 on the rear of the first portion 70, which enable the first portion 70 to be moved relative to the second portion 72, are illustrated in FIG. 6B.

The apparatus 10 comprises a battery for powering the apparatus 10 which is mounted within the second portion 72. The rear external surface 34B of the second portion 72 comprises the battery cover 76. The battery cover 76 may comprise a conductive material such as metal or a non-conductive material such as plastic.

The rear external surface 34B also comprises a conductive cover portion 16. In this third embodiment of the invention the conductive cover portion 16 is located on the second portion 72 of the apparatus 10 and defines the lower portion of the rear external surface 34B. In the embodiment illustrated in FIG. 6B the conductive cover portion 16 is substantially planar so that the conductive cover portion 16 is in a single plane and forms a substantially semicircular shape. In other embodiments of the invention the conductive cover portion 16 may be a different shape and may be shaped so that it is not substantially flat and is in more than one plane.

The conductive cover portion 16 is galvanically connected to a ground plane 44 by a ground connection 18. The ground connection 18 and the ground plane 44 are not illustrated in FIG. 6B as these are internal components of the apparatus 10. However the location of the ground point 42 is indicated by dashed lines in FIG. 6B.

The ground point 42 is located on the conductive cover portion 16 at the edge of the rear external surface 34B. In other embodiments of the invention the ground point 42 may be in a different position.

Figure 7A:
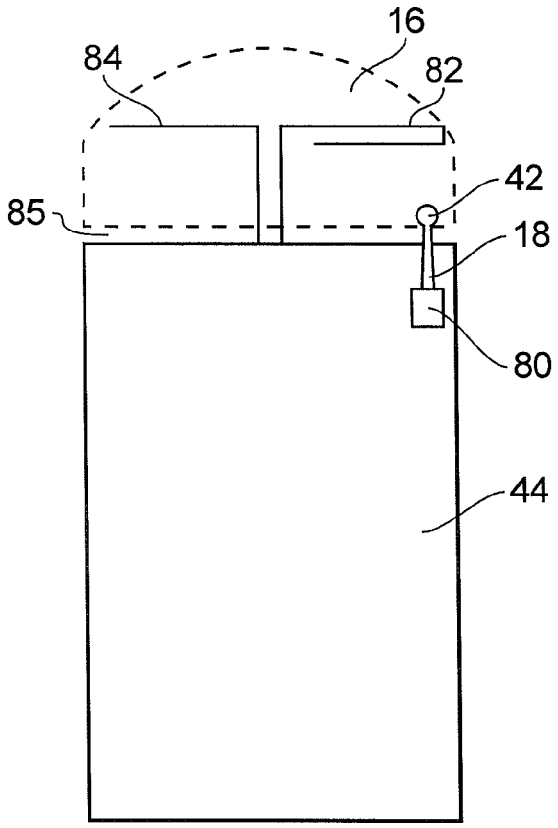
FIG. 7A is a front view of the third embodiment of the invention.
Figure 7B:
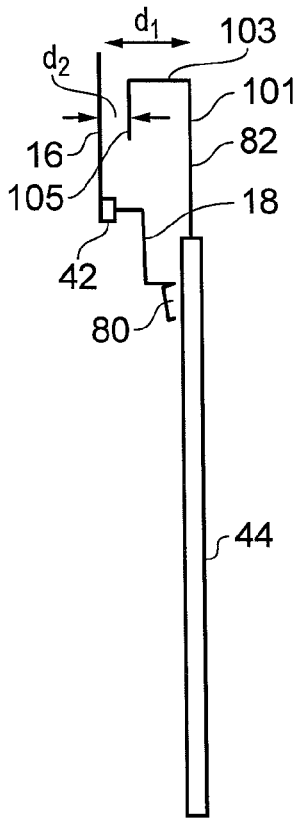
FIG. 7B is a side view of the third embodiment of the invention.

FIGS. 7A and 7B illustrate the third example embodiment of the invention illustrated in FIGS. 6A and 6B in more detail. In FIGS. 7A and 7B the casing 38, the functional circuitry 12, the radio circuitry 14 and the antenna arrangement 17 are not shown for clarity. FIG. 7A is a front view of the third embodiment of the invention and FIG. 7B is a side view of the third embodiment of the invention.

FIGS. 7A and 7B illustrate the conductive cover portion 16, the capacitive feed element 82 for feeding the conductive cover portion 16 and the ground plane 44. The ground plane 44 and the capacitive feed element 82 would be positioned inside the casing 38. The conductive cover portion 16 is indicated by dashed lines in FIG. 7A so that the antenna elements beneath it can be clearly illustrated.

In the illustrated embodiment the ground plane 44 is substantially flat and is located in a first plane. The conductive cover portion 16 is also substantially flat and is located in a second plane. The first and second planes are parallel to each other and a distance $d_1$ apart.

In some embodiments of the invention the ground plane 44 may also be a printed wiring board (PWB). As mentioned above, the radio circuitry 14 and the functional circuitry 12 have not been illustrated in FIGS. 7A to 7B for clarity but these may be mounted on the PWB and may be interconnected to the conductive cover portion 16 via the PWB.

A first capacitive feed element 82 is connected to the ground plane 44. The first capacitive feed element 82 is connected to the radio circuitry 14 which may be mounted on the ground plane 44. A second capacitive feed element 84 is provided adjacent to the first capacitive feed element 82. The second capacitive feed element is also connected to the radio circuitry 14.

The capacitive feed elements 82, 84 have lengths which configure them to resonate in conjunction with the conductive cover portion 16. The capacitive feed elements 82, 84 may be configured to resonate at different frequencies. The different frequencies may be in different frequency bands. For example the first capacitive feed element 82 may be configured to resonate in conjunction with the conductive cover portion 16 at approximately 900 MHz which would be in a frequency band such as EGSM 900 (880-960 MHz) or EU-WCDMA 900 (880-960 MHz) and the second capacitive feed element 84 may be configured to resonate in conjunction with the conductive cover portion at approximately 1800 MHz which would be in a frequency band such as PCN/DCS 1800 (1710-1880 MHz) or US-WCDMA 1900 (1850-1990 MHz).

In the embodiment illustrated in FIGS. 7A and 7B the capacitive feed elements 82, 84 are bent so that they are not wholly in the same plane as the ground plane 44. For example, as can been seen in the side view in FIG. 7B the first capacitive feed element 82 comprises a first portion 101, a second portion 103 and a third portion 105. The first portion 101 is in the same plane as the ground plane 44 and extends from the ground plane 44 underneath the conductive cover portion 16. The second portion 103 is substantially perpendicular to the first portion 101 and extends out of the plane of the ground plane 44 and towards the conductive cover portion 16. The third portion 105 is substantially perpendicular to the second portion 103 and runs parallel to the ground plane 44, the first portion 101 of the capacitive feed element 82 and the conductive cover portion 16. The third portion 105 is separated from the conductive cover portion 16 by a distance $d_2$. The distance $d_2$ is less than the distance $d_1$. The distance $d_2$ may be approximately 1 mm. The configuration of the capacitive feed element 82 may be selected so that the distance $d_2$ is controlled to ensure good coupling between the capacitive feed element 82 and the conductive cover portion 16.

The capacitive feed elements 82, 84 extend from the edge of the ground plane 44 and so do not overlay the ground plane 44.

The capacitive feed elements 82, 84 are positioned underneath the conductive cover portion 16 so that the capacitive feed elements 82, 84 act as feed elements which capacitively couple the radio circuitry 14 to the conductive cover portion 16 at the respective feed points 40.

A feed line may extend from the radio circuitry 14 to the capacitive feed elements 82, 84. The feed line may act as an inductor in series with the capacitance of the capacitive feed elements 82, 84. The feed line may extend along the ground plane 44. A single feed line may be used to connect both the first and second capacitive feed elements 82, 84 to the radio circuitry 14. A diplexer may be provided to separate the feed line into two.

The conductive cover portion 16 is positioned overlaying the capacitive feed elements 82, 84 so that the conductive cover portion 16 also does not overlay the ground plane 44. In the embodiment illustrated there is gap 85 between the edge of the ground plane 44 and the edge of the conductive cover portion 16 in the longitudinal direction so that there is no overlap between the conductive cover portion 16 and the ground plane 44. The width of this gap 85 may be approximately 1 mm.

The conductive cover portion 16 is galvanically connected to the ground plane 44 by a ground connection 18. The ground connection 18 extends between the ground plane 44 and the conductive cover portion 16 and galvanically connects the conductive cover portion to the ground plane 44 at the ground point 42.

In the illustrated embodiment the ground point 42 is located at the edge of the rear external surface 34B defined by the conductive cover portion 16. The relative positions of the feed point 40 and the ground point 42 may be selected to configure the conductive cover portion 16 to resonate at a particular resonant frequency in a particular resonant frequency band.

The ground connection 18 comprises decoupling circuitry 80 located between the conductive cover portion and the ground plane 44. The decoupling circuitry 80 may be, for example, an inductor. The decoupling circuitry 80 may be adjustable and may be used to tune the conductive cover portion 16 to resonate in one or more particular frequency bands. For example the decoupling circuitry 80 may comprise a variable inductor or may comprise a switching mechanism for switching between different inductors or different decoupling circuits. This enables the conductive cover portion 16 to be operable as an antenna in a plurality of frequency bands.

The decoupling circuitry 80 may be mounted on the PWB. In other embodiments of the invention the decoupling circuitry 80 and ground connection 18 may be in a different position.

In the embodiment illustrated in FIGS. 6 and 7 the capacitive feed elements 82, 84 and the ground connection 18 configure the conductive cover portion 16 to operate as an antenna. The separation between the respective feed points 40 and the ground point 42 can be controlled to control the impedance of the conductive cover portion 16 and consequently control the resonant frequency so that the conductive cover portion 16 is operable as an antenna in a particular frequency band.

The length of the feed line 21 may also be selected in order to configure the conductive cover portion 16 to resonate and be operable as an antenna in a particular frequency band. The distance between the ground plane 44 and the conductive cover portion 16 may also be selected so that the conductive cover portion 16 is configured to resonate and be operable as an antenna in a particular frequency band.

As the conductive cover portion 16 is connected to the ground plane 44 by decoupling circuitry 80 the conductive cover portion 16 may be operable as an antenna in more than one frequency band. For example the conductive cover portion 16 may be operable as an antenna in one or more cellular frequency bands such as US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz) or PCS1900 (1850-1990 MHz).

As in the previously described embodiments the conductive cover portion 16 defines part of the external surface 34 of the apparatus 10 and so it may make direct contact with a user. Using capacitive feed elements 82, 84 to capacitively couple the conductive cover portion 16 to the radio circuitry 14 ensures that the conductive cover portion 16 is physically separated from the radio circuitry 14 which reduces the detuning effect which occurs when the conductive cover portion 16 comes into contact with the users hand or ear. This may also prevent electrostatic discharge from being transmitted to the radio circuitry 14 and damaging the radio circuitry 14.

Also the conductive cover portion 16 is galvanically connected to the ground plane 44 via the decoupling circuitry 80. This provides additional protection for the radio circuitry 14 because any electrostatic charge which builds up on the conductive cover portion 16 can then dissipate through the ground connection 18 rather than through the capacitive feed elements 82, 84.

The third embodiment of the invention provides the same advantages as the above described embodiments. As the conductive cover portion 16 defines part of an external surface 34 of the apparatus 10 it does not take up any volume inside the apparatus 10 which enables the volume of the apparatus 10 to be reduced. Alternatively it enables an additional antenna arrangement to be added to an existing apparatus 10 without increasing the volume of the apparatus 10, or enabling the volume which would have been taken by the antenna arrangement to be used for alternative features.

Figure 8:
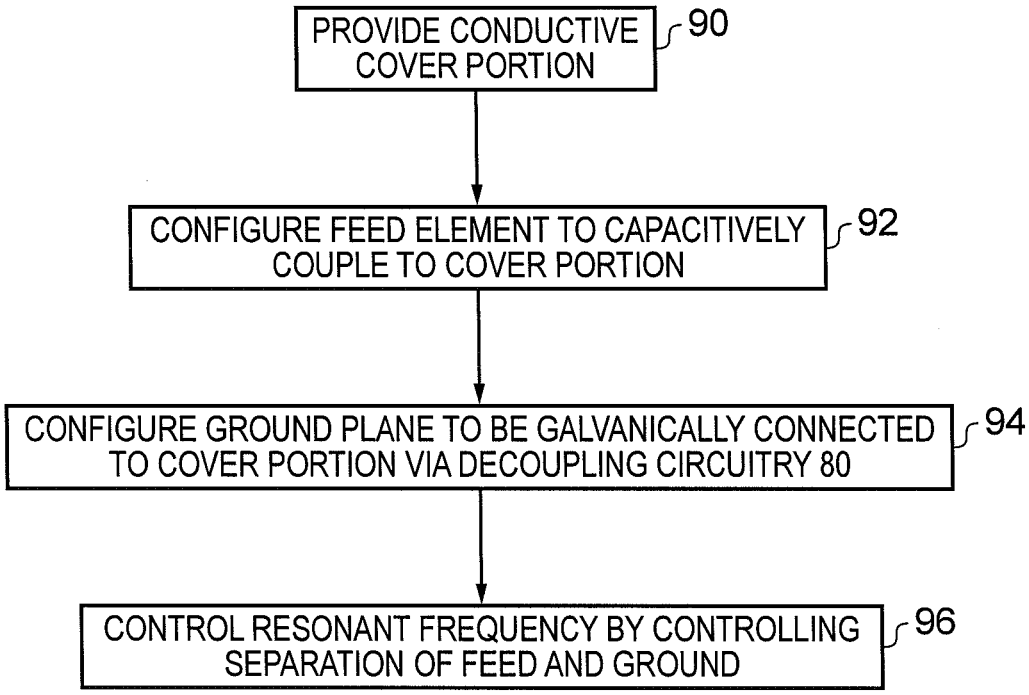
FIG. 8 illustrates a flow chart showing method blocks of the third embodiment of the present invention.

FIG. 8 illustrates a method of providing an apparatus according to an embodiment of the invention. At block 90 a conductive cover portion 16 is provided. The conductive cover portion 16 may be provided on the rear external surface 34B of an apparatus 10.

At block 92 a first capacitive feed element 82 is provided and configured to capacitively couple the conductive cover portion 16 to the radio circuitry 14 of the apparatus 10. At block 94 the ground plane 44 is galvanically connected to the conductive cover portion 16 via decoupling circuitry 80 so that the conductive cover portion 16 is configured to operate as an antenna. The decoupling circuitry may also enable the electrical length of the conductive cover portion 16 to be adjusted so that the conductive cover portion is operable as an antenna at a particular frequency.

At block 96 the resonant frequency of the conductive cover portion 16 is controlled by controlling the separation between the feed point 40 and the ground point 42 so that the conductive cover portion is operable at a selected frequency within a resonant frequency band.

Although the blocks of the method are illustrated in a particular order in FIG. 4 the illustration of a particular order of the blocks does not necessarily imply that there is a required or preferred order for the blocks and the order and arrangement of the blocks may be varied. Furthermore, it may be possible for some steps to be omitted. For example block 92 may be repeated so that more than one capacitive feed element is provided and configured to capacitively couple the conductive cover portion 16 to the radio circuitry 14.

Although embodiments of the present invention have been described in the preceding paragraphs with reference to various examples, it should be appreciated that modifications to the examples given can be made without departing from the scope of the invention as claimed. For example in the above description only one resonant mode is described for the conductive cover portion 16. It is to be appreciated that the conductive cover portion 16 may have more than one resonant mode and may be operable in more than one frequency band. For example the conductive cover portion 16 may have a first resonant frequency in the band 2400-2483.5 MHz which is used for communications in a wireless local area network (WLAN) or Bluetooth network and a second resonant frequency in the band 1570.42-1580.42 MHz which is used for GPS. The apparatus may comprise a matching circuit and/or a switch arrangement which is configured to tune the conductive cover portion so that it is operable as an antenna in both a Bluetooth frequency band and the GPS frequency band.

In some embodiments of the invention the conductive cover portion 16 may be configured to be tuned to be operable as an antenna at a number of different frequencies. For example, there may be one or more switching mechanisms connected to conductive cover portion 16 which enable the electrical length of the conductive cover portion 16 to be selected so that the conductive cover portion 16 is operable at a particular frequency. The switching mechanism may be connected to the feed line or the ground connection or there may be switching mechanisms connected to both the feed line and the ground connection.

Also in the above described first and second example embodiments the conductive cover portion is operable as a PIFA. It is to be appreciated that other types of antenna may be used such as IFAs, or unbalanced loop antennas, or other antennas which have both a feed line and a ground connection, etc.

The conductive cover portion 16 is described as being a bezel or trim around the edge of the apparatus 10 or the display 32. It is to be appreciated that the conductive cover portion 16 could be any part of the external surface 34 of the apparatus. For example, the conductive cover portion 16 may be a bezel around a user input device such as a keypad, touchpad, scrolling or rotary input device.

More than one embodiment of the invention may be incorporated into a single apparatus 10. For example an apparatus 10 may comprise a conductive bezel on a front surface in accordance with the first or second example embodiments described above and also a conductive cover portion on the rear surface of the apparatus 10 in accordance with the third example embodiment described above.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising;

a conductive cover portion defining at least a portion of an external surface of a portable electronic device wherein the conductive cover portion defines a bezel;

a feed element configured to capacitively couple radio circuitry to the conductive cover portion at a feed point;

a ground plane galvanically connected to the conductive cover portion at a ground point;

wherein the feed point and the ground point are separated along a length of the conductive cover portion and configure the conductive cover portion to resonate at a first resonant frequency so as to be operable as an antenna in a first frequency band and wherein the first resonant frequency of the conductive cover portion is controlled by the separation between the feed point and the ground point; and wherein the conductive cover portion is configured to operate as a planar inverted F antenna, or an inverted F antenna, in the first frequency band.

2. An apparatus as claimed in claim 1 wherein the conductive cover portion is a bezel around an edge of an external surface of the apparatus.

3. An apparatus as claimed in claim 1 wherein the conductive cover portion is a bezel around an edge of a display.

4. An apparatus as claimed in claim 1 wherein the conductive cover portion is a bezel around an edge of a user input device.

5. An apparatus as claimed in claim 1 comprising a matching circuit configured to enable the conductive cover portion to resonate at the first resonant frequency and at a second resonant frequency so that the conductive cover portion is operable as an antenna in both the first frequency band and a second frequency band.

6. An apparatus as claimed in claim 1 further comprising an antenna element within the apparatus configured to resonate at a further resonant frequency so as to be operable as an antenna in a further frequency band.

7. An apparatus as claimed in claim 6 wherein the further frequency band is a cellular frequency band.

8. A portable electronic device comprising an apparatus as claimed in claim 1.

9. A method comprising:

providing a conductive cover portion defining at least a portion of an external surface of a portable electronic device wherein the conductive cover portion defines a bezel;

configuring a feed element to capacitively couple radio circuitry to the conductive cover portion at a feed point;

configuring a ground plane to be galvanically connected to the conductive cover portion at a ground point;

positioning the feed point and the ground point such that the feed point and the ground point are separated along a length of the conductive cover portion and the conductive cover portion is configured to resonate at a first resonant frequency so as to be operable as an antenna in a first frequency band and wherein the first resonant frequency of the conductive cover portion is controlled by the separation between the feed point and the ground point; and wherein the conductive cover portion is configured to operate as a planar inverted F antenna, or an inverted F antenna, in the first frequency band.

10. A method as claimed in claim 9 comprising configuring a matching circuit to enable the conductive cover portion to resonate at the first resonant frequency and at a second resonant frequency so that the conductive cover portion is operable as an antenna in both the first frequency band and a second frequency band.

11. A method as claimed in claim 9 further comprising an antenna element within the apparatus configured to resonate at a further resonant frequency so as to be operable as an antenna in a further frequency band.

12. An apparatus comprising;

a conductive cover portion defining at least a portion of an external surface of a portable electronic device wherein the conductive cover portion defines a bezel;

at least one feed element configured to capacitively couple radio circuitry to the conductive cover portion at at least one feed point;

a ground plane galvanically connected to the conductive cover portion at a ground point;

wherein the feed point and the ground point are separated along a length of the conductive cover portion and configure the conductive cover portion to resonate at a first resonant frequency and a second resonant frequency so as to be operable as an antenna in at least a first frequency band and a second frequency band and wherein the first resonant frequency and the second resonant frequency of the conductive cover portion are controlled by the separation between the feed point and the ground point; and wherein the conductive cover portion is configured to operate as a planar inverted F antenna, or an inverted F antenna, in the first frequency band.

13. An apparatus as claimed in claim 12 wherein the ground plane is galvanically connected to the conductive cover portion via decoupling circuitry.

14. An apparatus as claimed in claim 12 wherein the conductive cover portion does not overlay the ground plane.

15. An apparatus as claimed in claim 12 wherein the conductive cover portion defines a portion of the rear external surface of the apparatus.

16. An apparatus as claimed in claim 12 wherein a first feed element is configured to resonate in conjunction with the conductive cover portion at the first resonant frequency and a second feed element is configured to resonate in conjunction with the conductive cover portion at the second resonant frequency.

17. An apparatus as claimed in claim 12 wherein the first feed element and the second feed element are connected to the radio circuitry by the same connection.

* * * * *